United States Patent [19]

Boyes et al.

[11] 4,038,357

[45] July 26, 1977

[54] MANUFACTURE OF SYNTHETIC FILAMENTS

[75] Inventors: Bryan Boyes; Alan Jones, both of Harrogate, England

[73] Assignee: Imperial Chemical Industries Inc., London, England

[21] Appl. No.: 594,933

[22] Filed: July 10, 1975

Related U.S. Application Data

[63] Continuation of Ser. No. 373,315, June 25, 1973, abandoned.

[30] Foreign Application Priority Data

June 28, 1972 United Kingdom ..... 30255/72

[51] Int. Cl.[2] ..... D01D 5/22

[52] U.S. Cl. ..... 264/168; 264/176 F; 264/237

[58] Field of Search ..... 264/176 F, 168, 237

[56] References Cited

U.S. PATENT DOCUMENTS

| | | | |
|---|---|---|---|
| 2,324,397 | 7/1943 | Hull | 264/176 F |
| 2,990,236 | 6/1961 | Reseley | 264/168 |
| 3,135,811 | 6/1964 | Barnett et al. | 264/176 F |
| 3,480,709 | 11/1969 | Jacob et al. | 264/168 |
| 3,511,905 | 5/1970 | Martin | 264/210 F |
| 3,538,722 | 11/1970 | Stream | 264/176 F |
| 3,576,931 | 4/1971 | Chopra et al. | 264/168 |
| 3,629,386 | 12/1971 | Knapp | 264/168 |

FOREIGN PATENT DOCUMENTS

| | | | |
|---|---|---|---|
| 42-11685 | 7/1967 | Japan | 264/210 F |

*Primary Examiner*—Jay H. Woo
*Attorney, Agent, or Firm*—Herbert M. Adrian, Jr.

[57] ABSTRACT

The present invention provides a method for the manufacture of potentially crimpable, synthetic linear polymer filaments which comprises the steps of melt spinning a plurality of filaments, initially partially cooling the hot filaments evenly with a stream of gas, and asymmetrically cooling the filaments further by causing them to contact continuously renewed thin film of liquid.

10 Claims, 1 Drawing Figure

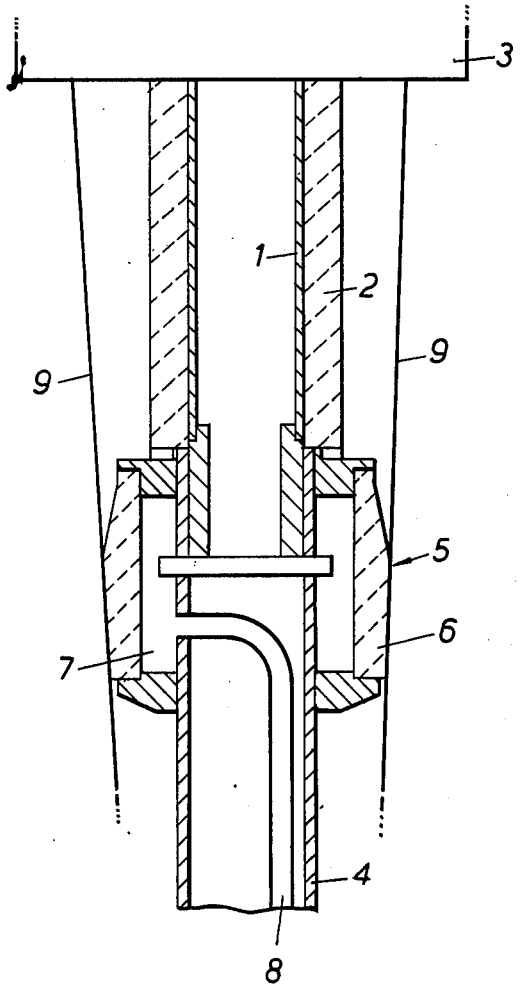
3
1
2
9
9
5
6
7
4
8

MANUFACTURE OF SYNTHETIC FILAMENTS

This is a continuation of application Ser. No. 373,315 filed June 25, 1973 and now abandoned.

The present invention relates to the manufacture of potentially crimpable filaments of synthetic linear polymers.

A known method for the manfacture of potentially crimpable filaments of synthetic linear polymers involves melt spinning, wherein the hot filaments coming from the spinneret are cooled asymmetrically by causing them to contact a thin film of cooling liquid such that one side only of each filament contacts the film of liquid. The crimp is developed by subjecting the filaments to a treatment including drawing and relaxing.

While this method has been used successfully on a commercial scale, it has several inherent disadvantages. A considerable range of frequencies and amplitudes of crimp can be obtained by varying the distance at which liquid application occurs below the spinneret and also the thickness of the liquid film which is being applied (i.e. by varying the liquid flow rate to the liquid applicator). However, only relatively coarse control of crimp parameters is achievable by these techniques. Critical control of the liquid flow rate is essential to maintain stable running of the process. Furthermore, this asymmetric cooling method is very difficult to operate with filaments of large deniers. The high heat content of these large filaments necessiatates the use of increased liquid flow rates which lead to problems of control, and yet which need to be controlled in order to achieve a proper asymmetric cooling/crimp situation.

The present invention seeks to provide an improved method for the manufacture of potentially crimpable filaments which obviates the above mentioned disadvantages.

Accordingly, the present invention provides a method for the manufacture of potentially crimpable, synthetic linear polymer filaments which comprises the steps of (A) melt spinning a plurality of filaments, (B) initially partially cooling the hot filaments evenly with a stream of gas, and (C) asymmetrically cooling the filaments further by causing them to contact a continuously renewed thin film of liquid which is at a temperature effectively below that of the filaments after step (B), the filaments contacting the film of cooler liquid in such a manner that one side only of each filament contacts the film of liquid. By this method, the crimpability of the filaments can be readily varied and finely controlled by adjusting the cooling effects of gas stream and the liquid relative to each other in such a manner that the temperature of the liquid is sufficiently below that of the partially cooled filaments so as to be effective to introduce the desired asymmetry in the filaments. Preferably, once the position of the liquid application has been established to give the coarse control of the crimp parameters, adjustment of the initial cooling conditions by the gas provides the fine control of the crimp parameters. In the case of large denier filaments, the initial cooling step may be made sufficient to reduce the heat content of the filaments to a level at which the introduction of asymmetry by the cooling liquid is effective.

Most desirably, the filaments are initially, uniformly cooled by a stream of gas which is directed radially outwards from a region substantially in the centre of the array of filaments issuing from a spinneret. Preferably, the stream of gas flows horizontally outwards from a vertical cylindrical surface located substantially below the centre of a single spinneret in which the holes are arranged in a circle or concentric circles.

The source of the radial outflow gas is preferably a vertical cylinder having a length between 3 to 10 inches, preferably 6 inches. The length of the cylinder and the rate of gas flow therethough is determined by the initial cooling required which is dependent upon such factors as the number and denier of the filaments, and the rate of extrusion of the filaments. The cylinder may be made of stainless steel mesh, porous materials such as porous earthenware or sintered bronze, or perforated sheets or tubes. As an alternative to a cylinder, a cone may be used which converges in a direction away from the spinneret.

The asymmetric cooling of the filaments is effected in a controlled manner, immediately following the initial uniform cooling by the gas stream, and is carried out by causing the filament which are maintained separate to contact a film of cooling liquid which is being continuously renewed, preferably, on the surface of a suitably shaped body. The surface covered by the cooling liquid is preferably the outer surface of a porous or perforated wall of a suitably shaped hollow body into the interior of which the liquid is fed so that it passes through the porous or perforated wall to the exterior surface thereof and forms a film or layer thereon. Suitably shaped bodies are described, for example, in U.K. Pat. Specification Nos. 809273 and 1087321. The thickness of the liquid film should be such that the filaments cannot be completely immersed therein.

Any hard-wearing porous or perforated foraminous material may be used such as ceramics or metals.

Water is preferred cooling liquid, although others may be used provided they have no harmful effects on the filaments. At the same time this proviso does not preclude cooling liquids being used which, or contain additives which, usefully affect the properties of the filaments. The crimp is developed in the filaments by subjecting them to a treatment which includes drawing the filaments in a liquid or in steam followed by heat relaxing or heat setting.

The method of the invention is applicable to filaments of polyester, polyamide, and polyolefines, for example.

The invention will be further described by way of example with reference to the accompanying drawing which is a cross-sectional side elevation of an apparatus for carrying out the method of the invention.

The apparatus comprises a perforated cylinder 1 having a porous shroud 2 mounted immediately below and sealed at its upper end by a spinneret 3. The cylinder 1 is mounted on a hollow support stem 4 which also serves as an air feed pipe to the cylinder 1. A cooling liquid applicator unit, generally designated 5, surrounds the stem 4 in the vicinity of the lower end of the cylinder 1.

The applicator unit 5 comprises a porous element 6 which defines a hollow chamber 7 with the stem 4. A supply pipe 8 for water passes interiorly of the stem 4 and communicates with the chamber 7 of the applicator unit 5.

In operation, air is supplied to the cylinder 1 via the stem 4 and passes from the cylinder 1 and through the porous shroud 2 as a horizontally radially directed gas stream which uniformly cools the filaments 9 issuing from the spinneret 3. The initially cooled filaments then contact a film of water on the surface of the porous element 6 which further cools them asymmetrically.

The following Examples are by way of illustration only.

EXAMPLE 1

Polyethylene terephthalate of intrinsic viscosity 0.675 was melt extruded through a spinneret with 424 holes each of 0.018 inch diameter arranged in a circle. The temperature of the wall of a filter sand pack immediately adjacent to the spinneret was maintained at 287° C. The spinning throughput of the polymer melt was 57 pounds per hour and the spum filaments were wound up onto a bobbin at a linear speed of 2350 feet per minute. The hot filaments were initially evenly cooled by air at ambient temperature passing radially outwardly through a quench unit, comprising a 4 inch long perforated stainless steel cylinder 1 having a porous shroud 2 of sintered bronze, at an air flow rate of 7 cubic feet per minute. A cooling liquid applicator unit 5 was positioned immediately below the quench unit. Water was caused to flow from the inside of a porous carborundum element 6 to its outer surface at a flow rate of 250 cubic centimetres per minute. The spun filaments were creeled from bobbins to form a tow which was passed through a bath containing a textile finishing agent, drawn to a ratio of 3.5:1 in steam, and dried and cooled at substantially constant length. The tow was then laid down in a tensionless condition on the moving brattice of an oven and heat treated at 140° C for 2 minutes.

The percentage Coefficient of Variation of the spun filament diameter was between 5 and 8, the decitex per drawn filament was 4.4 (circa 60 kilotex for the final drawn tow), and the % filament crimp was 50. The runnability of the method was in no way critical, i.e. it was considered stable.

COMPARATIVE EXAMPLE A

Polyethylene terephthalate of intrinsic viscosity 0.675 was melt extruded through a spinneret with 252 holes each of 0.018 inch diameter arranged in a circle. The temperature of the wall of a filter sand pack immediately adjacent to the spinneret was maintained at 276° C. The spinning throughput of the polymer melt was 35 pounds per hour and the spun filaments wound up onto bobbins at a linear speed of 3000 feet per minute. A cooling liquid applicator was positioned at 5.5 inches below the spinneret. As in Example 1, water was caused to flow through a porous carborundum element at a rate of 250 cubic centimeters per minute. The spum filaments were then formed into a tow, drawn in steam, dried, cooled and heat treated in accordance with Example 1, except that a draw ratio of 3.0:1 was used.

The decitex per drawn filament was 4.4 (circa 60 kilotex for the final drawn tow) and the % filament crimp was 50. However, without the initial forced air cooling, the production rate was reduced (polymer throughput down from 57 pounds per hour to 35 pounds per hour), the percentage Coefficient of Variation of the spun filament diameter worsened to between 15 and 20.

The above conditions were repeated except that the melt polymer throughout was increased to 47 pounds per hour using a spinneret with 336 holes each having a diameter of 0.018 inch arranged on a circle. The cooling liquid applicator was positioned 7 inches below the spinneret and utilised a water flow rate of 220 cubic centimeters per hour.

Again the drawn filament decited was 4.4 and the % filament crimp was 50. However, the percentage Coefficient of Variation of spun filament diameter was in excess of 20 and in terms of runnability the method was too unstable for it to be considered commercial.

EXAMPLE 2

The steps of Example 1 were repeated, except that the filaments were drawn in hot water, in accordance with the information given in Table 2.

The methods of the invention illustrated in Table 2 demonstrate that with the use of the combined air/water cooling it is possible with low, readily controllable water flow rates to obtain high denier filaments with high % crimp values and low % coefficients of variation of spum filament diameter.

COMPARATIVE EXAMPLE B

The steps of Comparative Example A were repeated, except that the filaments were drawn in hot water, in accordance with the conditions set forth in Table B. From Table B it is clearly seen that without initial forced air cooling of the filaments a high, critically controllable water rate is necessary to cool the filament assymetrically and yet only a low % crimp is obtained. Critical control of the high water rate is essential since the object of the water cooling is to cool each filament on one side only, whereas at such a high water rate it is extremely difficult to prevent the water encircling the filaments. Also it should be noted that the % Coefficient of Variation of the spun filament diameter is significantly greater than that of Example 2.

EXAMPLE 3

The steps of Example 1 were repeated according to the conditions given in Table 3, which also indicates some properties of the products obtained.

The information given in Table 3 shows that the water flow rate may be maintained at a low value is not critical while alteration and control of the % crimp all other factors being equal, may easily and readily be achieved by varying the initial air flow rate.

EXAMPLE 4

Polyethylene terephthalate filaments were prepared by following the steps described in Example 1 under the conditions illustrated in Table 4 — which also gives some physical properties of the filaments produced.

A comparison of processes (a) and (b) and (c), shows that the method of the invention allows considerable latitude in the value of the water flow rate while maintaining substantially constant the properties of the products being produced.

A comparison of processes (c) and (d) necessitates the same conclusion being drawn.

COMPARATIVE EXAMPLE C

Polyethylene terephthalate filaments were made by the steps described in Comparative Example A but in accordance with the conditions set forth in Table C.

a. Using water flow rate of 200 cubic centimeters per minute without initial forced air cooling proved to be unrunnable and so no filament properties were obtained. The main problem was inadequate wetting of the surface of the cooling liquid applicator.

b. Using a water flow rate of 220 cubic centimeters per minute without initial forced air cooling resulted in a product having a high % crimp and a high % coefficient of variation in spun filament denier.

c. Using a water flow rate of 250 cubic centimeters per minute without initial forced air cooling resulted in a product having a low % crimp and a high % coefficient of variation in spum filament denier.

From the results of Example 4 and Comparative Example C it is demonstrated that with the method of the invention there is achieved a reduced criticality of the water flow rate.

EXAMPLE 5

The methods of Examples 1 to 4 were repeated using porous elements 6 of sintered bronze and ceramic materials, and similar benefits and results were achieved.

CRIMP MEASUREMENT

The % crimp of the filaments is deterimed by taking a sample of tow 1.5 meters long, extending it by applying a 20 kilogram weight to one end thereof, it being suspended from its other end, and indicating by markings a gauge length (Lo) of 50 centimeters on the tow. The weight is then removed and the tow allowed to retract. Immediately thereafter, the retracted (L) between the markings is measured in centimeters. The % crimp is given by the formula $$\frac{Lo - L}{L} \times 100$$

The intrinsic viscosity of the polyethylene terephthalate was measured in ortho-chloro-phenol as solvent at 25° C.

TABLE 2

| | Polymer Melt Through-put lb/hr | Spun Filament Wind-up Speed f.p.m. | Spinneret No. of holes/ diameter inches | Polymer Intrin-sic Viscos-ity | Pack Wall Temp. ° C. | Water Flow Rate c.c./ min. | Air Flow Rate cu.ft/ min. | Nominal Distance of Cool-ing Liquid Applica-tor below Spinner-et inches | % Co-eff. of Varia-tion Spun filament Denier | % Crimp | Final Drawn Fila-ment Deci-tex | Draw Ratio (Hot water) |
|---|---|---|---|---|---|---|---|---|---|---|---|---|
| (a) | 60 | 2750 | 100/ 0.030 | 0.675 | 268 | 250 | 50 | 6 | 4 to 6 | 60 | 18 | 3.8:1 |
| (b) | 60 | 2750 | 100/ 0.030 | 0.675 | 268 | 250 | 70 | 10 | 4 to 6 | 50 | 18 | 3.8:1 |

TABLE B

| | | | | | | | | | | | | |
|---|---|---|---|---|---|---|---|---|---|---|---|---|
| | 60 | 2750 | 100/ 0.030 | 0.675 | 268 | 400 | — | 10 | 15 to 20 | 30 | 18 | 3.8:1 |

TABLE 3

| | Polymer Melt Through-put lb/hr | Spun Filament Wind-up Speed f.p.m. | Spinneret No. of holes/ diameter inches | Polymer Intrin-sic Viscos-ity | Pack Wall Temp. ° C | Water Flow Rate c.c./ min. | Air Flow Rate cu.ft/ min. | Nominal Distance of Cool-ing Liquid Applica-tor below Spinner-et inches | % Co-eff. of Varia-tion Spun Filament Diameter | % Crimp | Final Drawn Fila-ment Deci-tex | Draw Ratio (Steam) |
|---|---|---|---|---|---|---|---|---|---|---|---|---|
| (a) | 47 | 3000 | 336/ 0.015 | 0.675 | 285 | 250 | 10 | 6 | 5 to 8 | 35 | 4.4 | 3.0:1 |
| (b) | 47 | 3000 | 336/ 0.015 | 0.675 | 285 | 250 | 7 | 6 | 5 to 8 | 50 | 4.4 | 3.0:1 |

TABLE C

| | Polymer Melt Through-put lb/hr | Spun Filament Wind-up Speed f.p.m. | Spinneret No. of holes/ diameter inches | Polymer Intrin-sic Viscos-ity | Pack Wall Temp. ° C | Water Flow Rate c.c./ min. | Air Flow Rate cu.ft/ min. | Nominal Distance of Cool-ing Liquid Applica-tor below Spinner-et inches | % Co-eff. of Varia-tion Spun Filament Denier | % Crimp | Final Drawn Fila-ment Deci-tex | Draw Ratio (Steam) |
|---|---|---|---|---|---|---|---|---|---|---|---|---|
| (a) | 47 | 3000 | 336/ 0.015 | 0.675 | 276 | 200 | — | 7 | * | * | * | * |
| (b) | 47 | 3000 | 336/ 0.015 | 0.675 | 276 | 220 | — | 7 | 15 to 20 | 50 | 4.4 | 3.0:1 |
| (c) | 47 | 3000 | 336/ 0.015 | 0.675 | 276 | 250 | — | 7 | 15 to 20 | <35 | 4.4 | 3.0:1 |

*Results not obtainable.

TABLE 4

| | Polymer Melt Throughput lb/hr | Spun Filament Wind-up Speed f.p.m. | Spinneret No. of holes/ diameter inches | Polymer Intrinsic Viscosity | Pack Wall Temp. °C | Water Flow Rate c.c./ min. | Air Flow Rate cu. ft/ min. | Nominal Distance of Cooling Liquid Applicator below Spinneret inches | % Co-eff. of Variation Spun Filament Denier | % Crimp | Final Drawn Filament Decitex | Draw Ratio (Steam) |
|---|---|---|---|---|---|---|---|---|---|---|---|---|
| (a) | 47 | 3000 | 336/0.015 | 0.675 | 285 | 250 | 7 | 6 | 5 to 8 | 50 | 4.4 | 3.0:1 |
| (b) | 47 | 3000 | 336/0.015 | 0.675 | 285 | 300 | 7 | 6 | 5 to 8 | 50 | 4.4 | 3.0:1 |
| (c) | 57 | 2350 | 424/0.018 | 0.675 | 287 | 310 | 7 | 4 | 5 to 8 | 50 | 4.4 | 3.5:1 |
| (d) | 57 | 2350 | 424/0.018 | 0.675 | 287 | 250 | 7 | 4 | 5 to 8 | 50 | 4.4 | 3.5:1 |
| (e) | 47 | 3000 | 336/0.015 | 0.675 | 285 | 350 | 7 | 6 | 5 to 8 | 45 | 4.4 | 3.0:1 |

What we claim is:

1. A method for the manufacture of potentially crimpable, synthetic linear polymer filaments which comprises the steps of (A) melt spinning a plurality of filaments, (B) initially partially cooling the hot filaments evenly with a stream of radial outflowing quence gas over a distance commencing from the spinneret and extending 3 to 10 inches below it, and (C) asymmetrically cooling the filaments further by causing them to contact a continuously renewed thin film of liquid less than the thickness of the filaments which liquid is at a temperature effectively below that of the filaments after step (B), the filaments contacting the film of cooler liquid in such manner that one side only of each filament contacts the film of liquid.

2. A method according to claim 1, wherein the crimpability of the filaments is varied and controlled by adjusting the cooling effects of the gas stream and the liquid relative to each other.

3. A method according to claim 1, wherein coarse selection of the desired crimpability is controlled by the application of the cooling liquid to the filaments, and adjustment of the initial cooling conditions by the gas provides a fine control of the desired crimpability.

4. A method according to claim 1 wherein the filaments are initially cooled by a stream of gas which is directed radially outwards from a region substantially in the centre of the array of filaments issuing from a spinneret.

5. A method according to claim 4, wherein the filaments in the array are maintained separate during their contact with the film of cooling liquid which is being applied thereto in a controlled manner.

6. A method according to claim 1, wherein the film of cooling liquid is being continuously renewed on the surface of a suitably shaped body.

7. A method according to claim 7, wherein the surface covered by the cooling liquid is preferably the outer surface of a porous or perforated wall of a suitably shaped hollow body into the interior of which the liquid is fed so that it passes through the porous or perforated wall to the exterior surface thereof.

8. The method of claim 1 wherein the quench gas is used in an amount of 7 to 70 cubic feet per minute.

9. The method of claim 1 wherein the frequency in amplitude of the crimp is controlled by interdependently adjusting the cooling effect of steps (B) and (C) to yield a desired potential crimp in the quenched filaments.

10. The method of claim 8 wherein the volume of quench gas is adjusted to give the degree of crimp frequency and amplitude based on the spinning speed and air cooling distance.

* * * * *